US007741825B2

(12) United States Patent
Lenz

(10) Patent No.: US 7,741,825 B2
(45) Date of Patent: Jun. 22, 2010

(54) POWER SUPPLY CIRCUIT WITH TEMPERATURE-DEPENDENT DRIVE SIGNAL

(75) Inventor: Michael Lenz, Zorneding (DE)

(73) Assignee: Infineon Technologies AG, Munich (DE)

( * ) Notice: Subject to any disclaimer, the term of this patent is extended or adjusted under 35 U.S.C. 154(b) by 275 days.

(21) Appl. No.: 11/592,036

(22) Filed: Nov. 2, 2006

(65) Prior Publication Data

US 2008/0129267 A1 Jun. 5, 2008

(51) Int. Cl.
*G05F 1/00* (2006.01)

(52) U.S. Cl. ..... 323/284; 323/285

(58) Field of Classification Search ..... 323/284, 323/285, 292; 320/153; 218/57, 82, 84, 218/143, 154, 189.09
See application file for complete search history.

(56) References Cited

U.S. PATENT DOCUMENTS

| | | | | |
|---|---|---|---|---|
| 5,955,869 | A * | 9/1999 | Rathmann | 320/132 |
| 6,025,695 | A * | 2/2000 | Friel et al. | 320/106 |
| 6,058,036 | A * | 5/2000 | Endo et al. | 363/98 |
| 6,233,128 | B1 * | 5/2001 | Spencer et al. | 361/86 |
| 6,236,186 | B1 * | 5/2001 | Helton et al. | 320/106 |
| 7,262,752 | B2 | 8/2007 | Weindorf | |
| 2004/0196678 | A1 * | 10/2004 | Yoshimura et al. | 363/79 |
| 2004/0207532 | A1 * | 10/2004 | Smithson | 340/643 |
| 2005/0030192 | A1 * | 2/2005 | Weaver et al. | 340/815.45 |
| 2005/0140315 | A1 | 6/2005 | Baldwin et al. | |
| 2006/0007721 | A1 * | 1/2006 | Rodriguez et al. | 363/146 |
| 2006/0050455 | A1 * | 3/2006 | Sumida et al. | 361/56 |
| 2006/0091872 | A1 * | 5/2006 | Matsuura | 323/283 |
| 2006/0225447 | A1 * | 10/2006 | Yamamoto et al. | 62/197 |
| 2006/0261752 | A1 * | 11/2006 | Lee | 315/291 |
| 2007/0040514 | A1 * | 2/2007 | Pong et al. | 315/185 S |
| 2007/0076342 | A1 * | 4/2007 | Arndt | 361/103 |
| 2007/0251813 | A1 * | 11/2007 | Ilic et al. | 204/192.1 |
| 2008/0043579 | A1 * | 2/2008 | Shigeta | 369/44.11 |

FOREIGN PATENT DOCUMENTS

| | | | |
|---|---|---|---|
| DE | 19810827 | A1 | 9/1999 |
| DE | 19930174 | A1 | 1/2001 |
| DE | 10201053 | A1 | 8/2002 |
| DE | 10239449 | A1 | 8/2003 |
| DE | 60007610 | T2 | 11/2004 |
| DE | 102004028987 | A1 | 1/2006 |
| DE | 102004060890 | A1 | 6/2006 |
| WO | 0105193 | A1 | 1/2001 |
| WO | 2006063552 | A1 | 6/2006 |

* cited by examiner

*Primary Examiner*—Edward Tso
*Assistant Examiner*—Arun Williams
(74) *Attorney, Agent, or Firm*—Maginot, Moore & Beck

(57) ABSTRACT

A power supply circuit is disclosed herein comprising a load current path for connecting a load which has a switching element. The power supply circuit also includes a current sensor for providing a current measurement signal dependent on a current through the load current path. A drive circuit is also included which provides a clocked drive signal with a number of drive cycles, in each case having an on period and an off period, for the switching element. A temperature sensor arrangement with a temperature sensor is provided for determining an environmental temperature in the area of the temperature sensor, which provides a temperature measurement signal dependent on the environmental temperature. The clocked drive signal is dependent on the current measurement signal and the temperature measurement signal.

18 Claims, 8 Drawing Sheets

POWER SUPPLY CIRCUIT WITH TEMPERATURE-DEPENDENT DRIVE SIGNAL

TECHNICAL FIELD

The present invention relates to a regulated power supply circuit for providing a supply current for a load, particularly for a load having at least one light-emitting diode (LED), and to a circuit arrangement with a power supply circuit.

BACKGROUND

Power light-emitting diodes (LEDs) are increasingly used as replacement for conventional incandescent lamps, for example in motor vehicles. Compared with conventional light-emitting diodes, power light-emitting diodes have a higher power consumption and thus also a higher light yield and are subject to greater heating. Light-emitting diodes are usually mounted on printed circuit boards (PCBs) which can be damaged or destroyed when temperatures are too high. If there is no adequate cooling, a light-emitting diode mounted on a printed circuit board can therefore damage the printed circuit board. The smaller the printed circuit board and thus the lower its capability of removing dissipated power converted into heat, the greater this problem is.

SUMMARY

A power supply circuit according to an embodiment of the invention comprises a load current path for connecting a load with the load path current having a switching element, a current sensor for providing a current measurement signal dependent on a current through the load current path, a drive circuit providing a clocked drive signal with a number of drive cycles, each having an on period and an off period, for the switching element, and a temperature sensor arrangement with a temperature sensor for determining an environmental temperature in the area of the temperature sensor, providing a temperature measurement signal dependent on the environmental temperature. The clocked drive signal of this power supply circuit has a duty ratio which is dependent on the current measurement signal and the temperature measurement signal.

The switching element, which is driven in a clocked manner, controls the power consumption of the power supply circuit and thus the power consumption of the load. This power consumption is dependent on the duty ratio of the drive signal driving the switching element. Adjustment of the duty ratio of this clocked drive signal in dependence on the temperature provides for regulation of the power consumption in dependence on the temperature in the environment of the light-emitting diode.

The above described features and advantages, as well as others, will become more readily apparent to those of ordinary skill in the art by reference to the following detailed description and accompanying drawings.

BRIEF DESCRIPTION OF THE DRAWINGS

In the following, embodiments of the invention will be explained in figures.

DESCRIPTION

Figure 1:
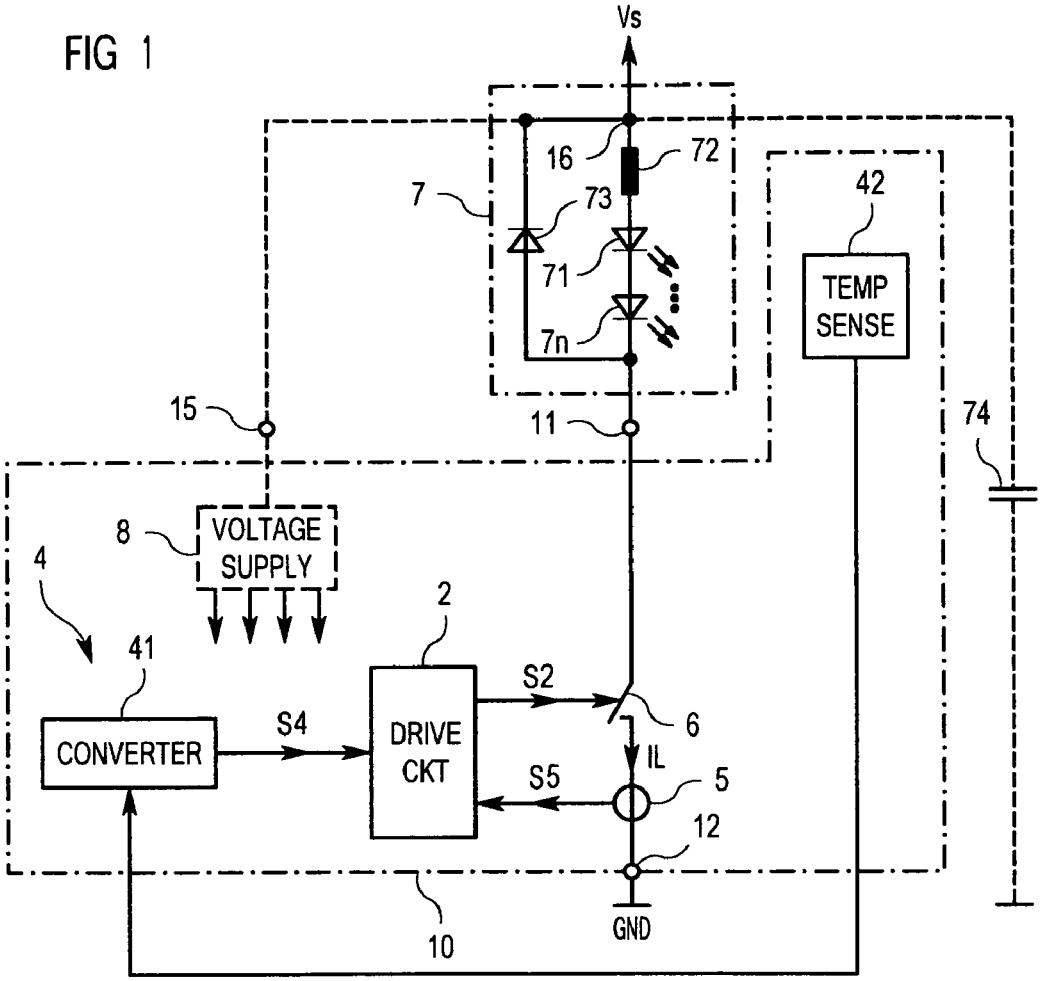
FIG. 1 shows a circuit diagram of an exemplary embodiment of a power supply circuit according to the invention which has a load current path with a switch, a drive circuit for the switch and a temperature sensor arrangement.

FIG. 1 shows an embodiment of a power supply circuit 10 for supplying current to a load. This power supply circuit 10 has a load current path which extends between first and second connecting terminals 11, 12 of the power supply circuit 10 in the example. Into this load current path, a switching element 6 is connected which is used for supplying clocked current to a load 7 which can be connected to the load current path and which, during the operation of the power supply circuit, is driven by a driving circuit 2 by means of a clocked drive signal S2. The clocked drive signal S2 has a number of drive cycles following one another in time during the operation of the power supply circuit, each drive cycle having an on period and an off period. The switching element 6 is driven to conduct (switched on) during the on periods and driven to block (switched off) during the off periods. A duty ratio d of this clocked drive signal S2 during one drive cycle is defined by the quotient of the on period during this drive cycle and the total duration of this drive cycle, i.e. the sum of the on period and the off period. Thus, the following applies:

$$d=T\text{on}/T=T\text{on}/(T\text{on}+T\text{off}) \quad (1)$$

where Ton designates the on period during a drive cycle, Toff designates the off period during this drive cycle, and T designates the duration of the drive cycle.

The drive circuit 2 generates the clocked drive signal S2 in such a manner that its duty ratio is dependent on a load current IL in the load current path and on a temperature measurement signal S4 provided by a temperature sensor arrangement 4. An information about the instantaneous value of the load current IL flowing through the load current path is supplied to the drive circuit 2 in the form of a current measurement signal S5 being provided by a current sensor 5 and being proportional to the load current IL.

The current sensor 5 may be any current sensor suitable for measuring the load current IL and providing the current measurement signal S5. The current sensor may be implemented, for example, by a measuring resistor connected into the load current path, across which the load current produces a voltage drop which corresponds to the measurement signal S5.

The switching element 6 may be implemented, for example, as bipolar power transistor or as power MOS transistor which has a multiplicity of similar transistor cells connected in parallel. With such an implementation of the switching element 6, the load current IL can be measured, and thus the current measurement signal S5 can be provided, in a manner not shown in greater detail, in accordance with the so-called current-sensing principle. In this method, the cell array is subdivided into a first group of transistor cells, the so-called load cells, and a second group of transistor cells, the so-called measuring cells. The load cells are used for supplying current to a connected load whilst the measuring cells are used for current measurement and are operated at the same operating point as the load cells by means of a suitable drive. A measuring current flowing through the measuring cells is then related to the load current via the quotient of the number of measuring cells to the number of load cells. In this arrangement, the measuring current can be used directly for generating a current measurement signal, for example by means of a measuring resistor.

In the example shown in FIG. 1, the temperature sensor arrangement 4 has a temperature sensor 42 which is used for determining an environmental temperature and which may be arranged directly adjacent to the load 7, or at a distance from the load 7. This temperature sensor 42 is connected to a converter unit 41 which generates from an environmental temperature detected by the temperature sensor 42 the temperature measurement signal S4 depending on this environmental temperature.

The load 7 connected to the load current path of the power supply circuit 10 comprises in the embodiment shown a series circuit of an inductive storage element 72, for example a coil, and at least one light-emitting diode 71, 7*n*. In the example, two light-emitting diodes 71, 7*n* are connected in series with the inductive storage element but as is indicated graphically by dots, an arbitrary number of light-emitting diodes may be connected in series with the inductive storage element 72, dependant on a desired illumination situation.

A freewheeling element 73 is connected in parallel with the series circuit with the inductive storage element 72 and the light-emitting diodes 71, 7*n*. The freewheeling element, in the example, is implemented as diode and is used for handling a current flowing due to a previously magnetized inductive storage element 72 being commutated off when the switching element 6 is switched off. As an alternative to a passive component such as the diode shown, the freewheeling element 73 may also be implemented in a manner not shown in greater detail, by an active component such as, for example, a transistor which is interconnected as so-called synchronous rectifier.

The freewheeling element 73 is shown as part of the load 7 in FIG. 1. However, it is also possible to provide this freewheeling element 73 in the drive circuit. The drive circuit 10 then has an additional connecting terminal 16 which is shown dashed in FIG. 1 and which is used for connecting the freewheeling element 73 to the terminal for the supply potential Vs. In such a drive circuit, the load is connected between the first connecting terminal 11 and this further connecting terminal 15.

To compensate for voltage fluctuations and to smooth the current variation in the supply line to the load of the supply voltage, a buffer capacitor 74, which is shown dashed in FIG. 1, may be connected in parallel with the series circuit of the load and the load current path. Smoothing the current variation in the supply line is useful with regard to reducing ripple and thus to reducing the EMC radiation.

To supply the circuit components of the drive circuit 10 with voltage, a voltage supply circuit 8 (shown dashed) may be provided which is connected to the terminal for the supply potential Vs via a connecting terminal 15 and which is used, for example, for converting the supply potential for the load to a potential suitable for supplying the circuit components. Connection lines between the voltage supply circuit 8 and the other circuit components are shown only schematically in FIG. 1.

The basic operation of the power supply circuit 10 shown will briefly be explained in the following:

The series circuit of the load current path of the power supply circuit 10 and of the load 7 is connected between a terminal for a first supply potential Vs and a second supply potential or reference potential GND, respectively, during the operation of the power supply circuit. When driving to the switching element 6 in a clocked fashion, i.e. when alternatingly driving the switching element 6 to conduct for an on period and to block for an off period, the supply voltage present between the terminals for the supply potential—under the assumption of a negligible on resistance of the switching element 6—is applied in a clocked fashion to the load 7 and produces a current flow through the load. With a supply voltage present across the load 7, i.e. during the on periods of the switching element 6, the inductive storage element 72 stores electrical energy which, during following off periods, produces a continuing current through the light-emitting diodes 71, 7*n* via the freewheeling element 73. In this circuit arrangement, the inductive storage element 72 effects a smoothing of the current variation in comparison with a load arrangement in which there is no such inductive storage element and in which the load current would have to be limited with the aid of a limiting resistor which. A limiting resistor, however, would lead to high power dissipation and thus to a reduction in the overall efficiency, with increased heat development.

Figure 2:
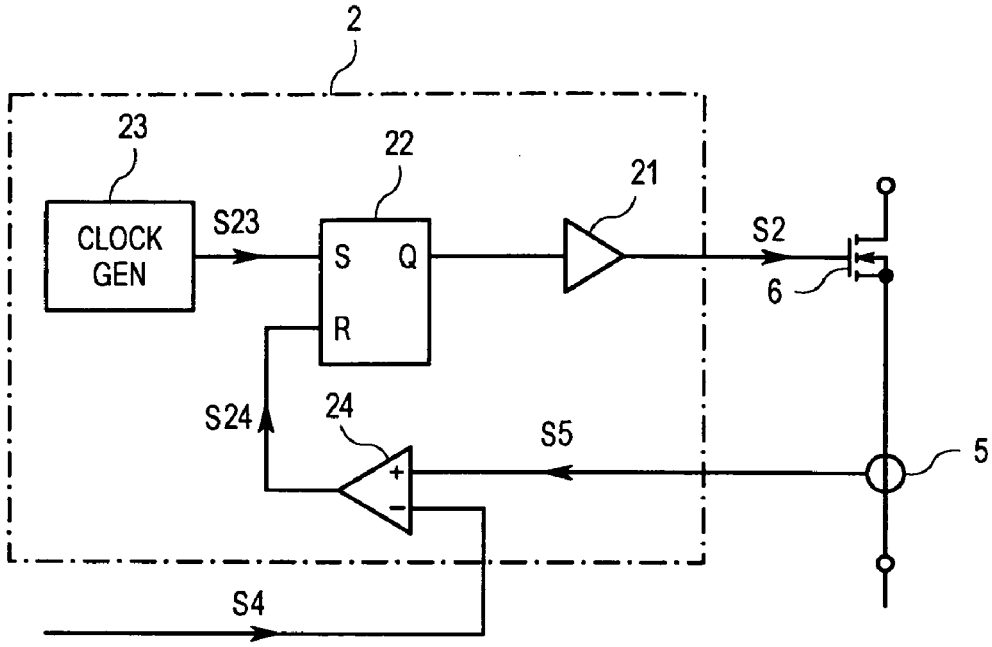
FIG. 2 shows an exemplary embodiment of the drive circuit.

A first example of a drive circuit 2 for generating the clocked drive signal S2 for the switching element 6 is shown in FIG. 2. For a better understanding, in FIG. 2 the switching element 6 which, in the present example, is implemented as n-channel power MOSFET, and the current sensor 5 which generates the current measurement signal S5, are also shown in addition to the drive circuit 2. In the example shown, the drive circuit 2 has a flip-flop 22 with a set input S and a reset input R, and has a clock generator 23, for example an oscillator, connected to its set input which generates a clock signal S23 and which sets the flip-flip 22 at the rate of this clock signal S23. The drive signal S2 is available at a non-inverting output Q of the flip-flop 22 wherein a driver circuit 21, which is used for converting a signal level of the output signal of the flip-flop 22 to a signal level suitable for driving the switching element 6, is optionally connected between the flip-flop 22 and the switching element 6. In this drive circuit 2, the switching element 6 is driven to conduct switched on when the flip-flop is set.

In the drive circuit of FIG. 2, the flip-flop 22 is reset, and thus the switching element 6 is driven to block, in dependence on the current measurement signal S5 and the temperature measurement signal S4. In this arrangement, a comparator 24 compares the current measurement signal S5 with the temperature measurement signal S4 and resets the flip-flop 22 in dependence on a comparison of these two signals. In the example, the flip-flop 22 is reset via a comparator output signal S24 of the comparator 24 whenever the current measurement signal S5 reaches the value of the temperature measurement signal S4.

Figure 3:
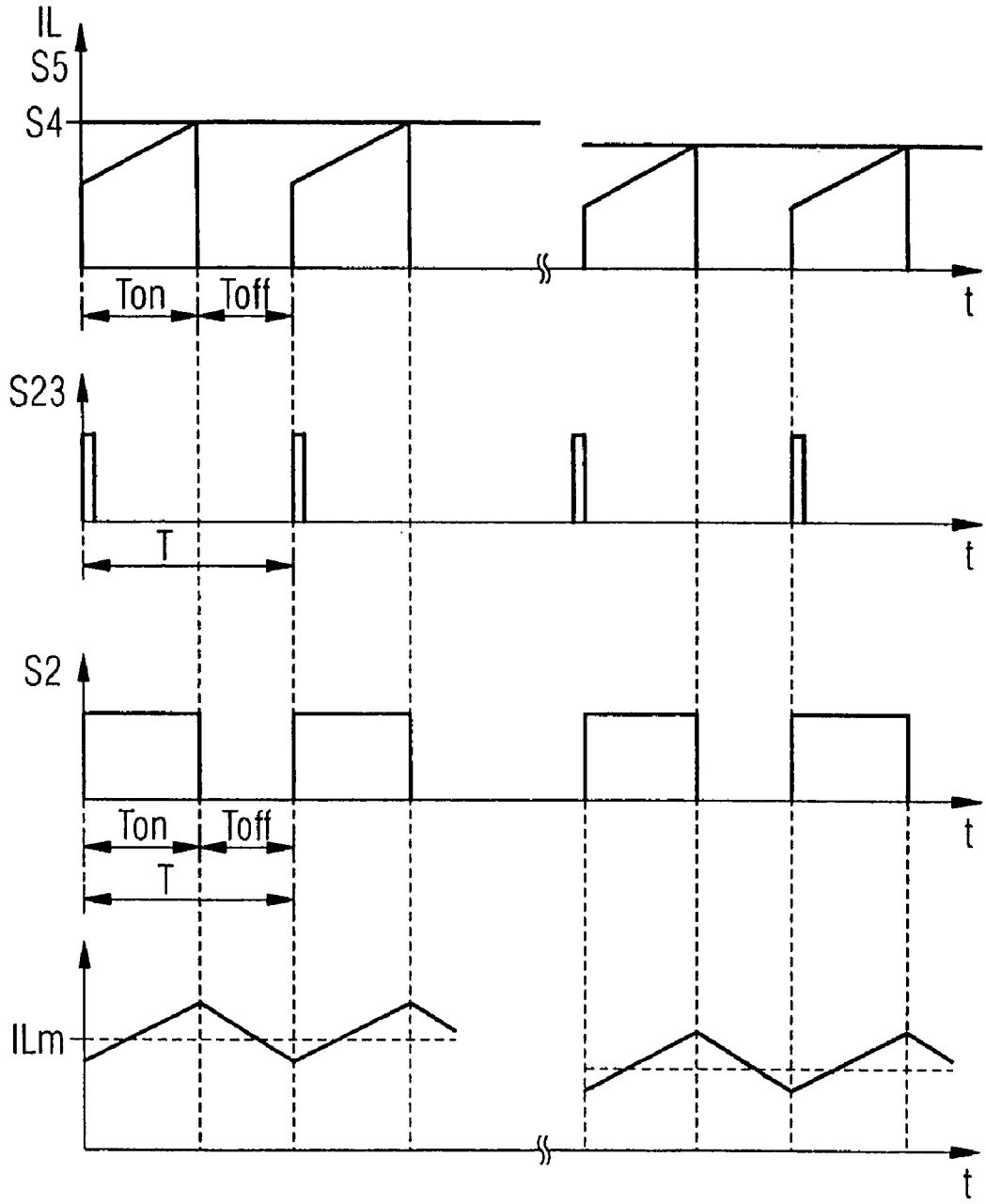
FIG. 3 illustrates the operation of a power supply circuit with a drive circuit according to FIG. 2 by means of time variations of selected signals occurring in the power supply circuit.

FIG. 3 illustrates the operation of a power supply circuit having a drive circuit according to FIG. 2, by means of timing diagrams of the clock signal S23, of the current measurement signal S5 and of the temperature measurement signal S4. For the purposes of the explanation, it is assumed that the power supply circuit is in a steady state, that is to say some drive cycles by means of which the switching element 6 has been driven to conduct and to block have already taken place up to the signal diagram shown in FIG. 3. For the purposes of the explanation, it is also assumed that the clock signal S23 has clock pulses occurring every time period T and that the flip-flop 22 is set with a rising edge of these clock pulses. In addition, it is assumed for the representation in FIG. 3 that the duration of the drive cycles is selected in such a manner that the inductive storage element 72 of the load 7 does not completely commutate off during one drive cycle in the steady state of the system.

When the flip-flop 22 is set and thus the switching element 6 is driven to conduct, the current in the switching element 6, and thus the current measurement signal S5, ramps up, the slope dIL/dt of the rising edge of the current variation being dependent on the supply voltage applied and on the inductance value of the inductive storage element 72. The following applies:

$$dIL/dt=Vs/L, \tag{2}$$

where dIL/dt represents the derivation of the current IL with time.

The flip-flop 22 remains set, and the switching element 6 remains driven to conduct, until the rising current measurement signal S5 reaches the value of the temperature measurement signal S4. The load current IL flowing through the load current path in this power supply circuit has a triangular current shape fluctuating about a mean value ILm. This mean value is dependent on the temperature measurement signal S4 which, via the comparator (24 in FIG. 2) and the current measurement signal S5, limits the maximum value of the load current IL towards the top. FIG. 3 shows time variations of the current measurement signal S5, of the drive signal S2 and of the load current IL for two different amplitudes of the current measurement signal S4. For the greater one of the two amplitudes for which the signal variations are shown in the left-hand part of FIG. 3, the mean value ILm of the load current IL assumes a higher value than for the lower value of the temperature measurement signal S4 for which the signal variations are shown in the right-hand part of FIG. 3. It should be pointed out that the duty ratio of the drive signal S2 in the steady state of the power supply circuit may be equal for different mean values of the load current. With the fixed-clocked drive to the switching element, shown by means of FIG. 3, however, the duty ratio of the control signal S2 varies from a first value to a second value at least during transition phases of the temperature measurement signal S4 and the duty ratio is thus dependent on the temperature at least temporarily.

Figure 4:
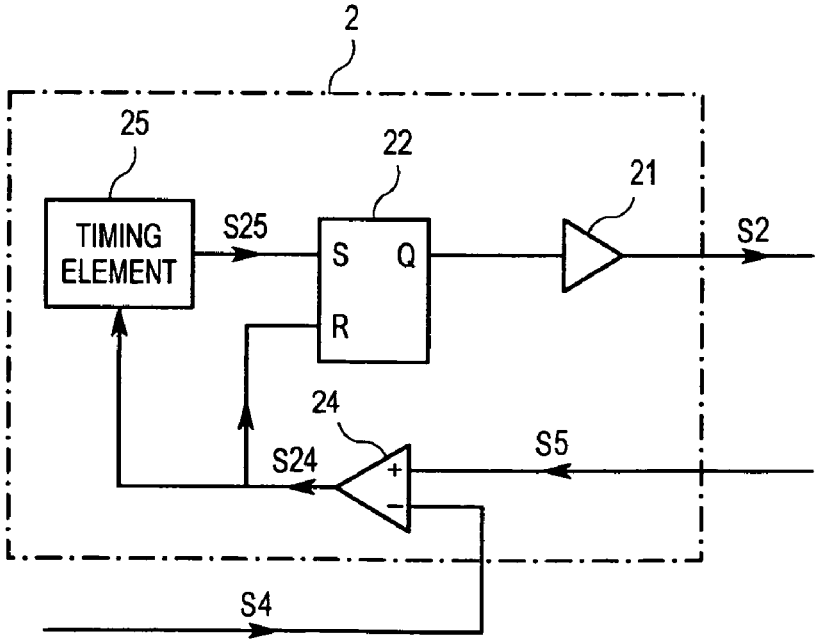
FIG. 4 shows a further exemplary embodiment of the drive circuit.

FIG. 4 shows a further example of a drive circuit 2 for generating a drive signal S2. In this drive circuit, a timing element 25 is provided instead of an oscillator, which is connected to the set input of the flip-flop 22 and to which the comparator output signal S24 is supplied. In the drive circuit of FIG. 4, this timing element 25 produces a predetermined off period of the drive signal S2 in that the timing element 25 sets the flip-flop 22 again after a predetermined period has elapsed after the presence of a reset signal. In this drive circuit 2, the output signal S24 of the comparator 24 is supplied both to the reset input R of the flip-flop 22 and to an input of the timing element 25. The timing element 25 is started with a predetermined edge of the comparator output signal S24, for example with a rising edge, and, after a predetermined period of time has elapsed, generates a predetermined edge of the timing element output signal S25, for example a rising edge, for setting the flip-flop 22.

Figure 5:
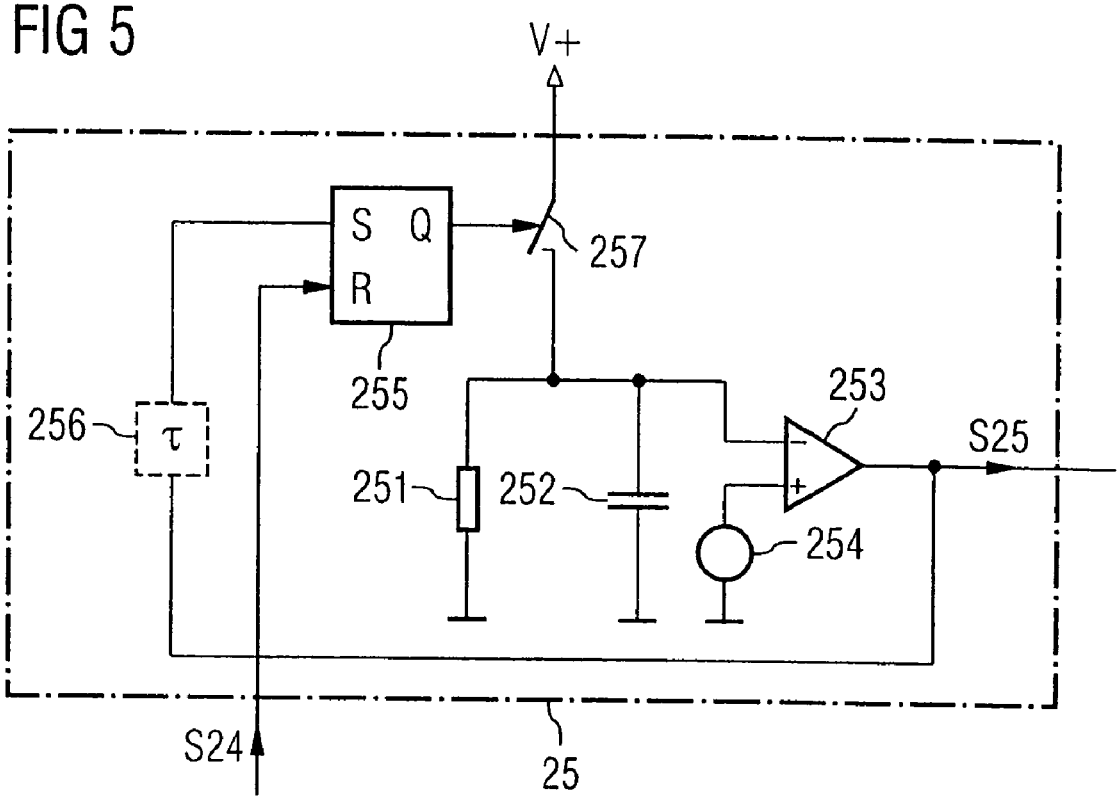
FIG. 5 shows an exemplary circuit embodiment of a timing element present in the drive circuit according to FIG. 4.

Referring to FIG. 5, the timing element 25 comprises, for example, RC element with a resistance element 251 and a capacitive storage element 252 connected in parallel with the resistance element 251. This RC element is connected to a terminal for a supply potential V+via a switch 257. When the switch 257 is driven to conduct, the capacitive storage element 252 of this timing element 25 is charged up to the value of the supply potential V+. When the switch 257 subsequently blocks, the capacitive storage element 252 discharges via the resistance 251. A comparator 253 compares the voltage present across the capacitive storage element 252 with a reference value predetermined by a reference voltage source 254 and generates the output signal S25 of the timing element, present at the output of this comparator 253, in dependence on a comparison of the reference voltage with the voltage across the capacitive storage element 252. In the case of the timing element shown in FIG. 5, a rising edge of the output signal S25 is generated if, with the switch 257 opened, the voltage across the capacitive storage element 252 has dropped below the value of the reference voltage. With this timing element 25, the switch 257 is opened in dependence on the output signal S24 of the comparator 24 comparing the current measurement signal S5 and the temperature measurement signal S4. This comparator signal S24 is supplied to a reset input R of a flip-flop 255 which drives the switching element 257. As the flip-flop 255 is reset by this comparator signal S24, the switch 257 is opened which corresponds to a beginning of the waiting time predetermined by the timing element 25. The end of the waiting time predetermined by the timing element 25 is reached when the capacitive storage element 252 has been discharged down to the value of the reference voltage via the resistance element 251. The flip-flop 255 is then set again by the output signal S25 present at the output of the comparator 253 in order to close the switch 257 and to again charge up the capacitive storage element 252 up to the beginning of the next waiting time. Optionally, a delay element 256 can be connected upstream of a set input S of the flip-flop 255 in order to achieve a stable operational characteristic of the timing element 25.

Figure 6:
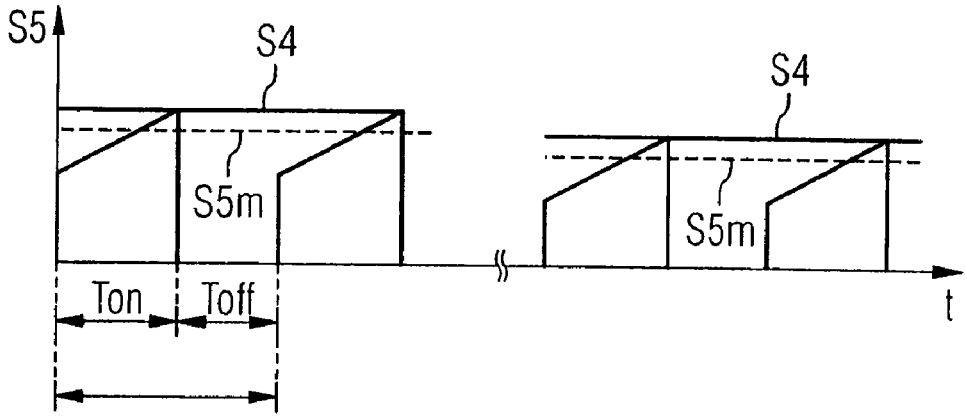
FIG. 6 illustrates the operation of a power supply circuit according to at least one embodiment of the invention with a drive circuit according to FIG. 4 by means of time variations of selected signals occurring in the power supply circuit.

In the following the operation of a power supply circuit with a drive circuit of FIG. 4 is explained with reference to FIG. 6. FIG. 6 shows by way of example a time variation of the current measurement signal S5 in dependence on the temperature measurement signal S4 for two different values of the temperature measurement signal S4. The load current consumption is regulated via the temperature measurement signal S4, the switching element 6 being blocked in each case when the current measurement signal S5 ramping up reaches the value S4 with an initially conducting switching element 6. The switching element then remains switched off for an off period Toff predetermined by the timing element 25 and is then switched on again for an on period Ton depending on the load current IL flowing and the temperature measurement signal S4. In the steady state of the power supply circuit, the duty ratio of the drive signal S2 can in each case assume equal values for different values of the temperature measurement signal S4. However, the duty ratio is fundamentally dependent on the temperature measurement signal S4 and changes, for example, with a change in the temperature measurement signal S4. Thus, the duty ratio initially decreases with decreasing current measurement signal S4 until the load current has corrected itself to a new signal value adapted to the temperature measurement signal.

Depending on how the temperature measurement signal S4 is generated in dependence on the environmental temperature detected by the temperature sensor 42, either a decrease in the load current or the mean value of the load current, respectively, or an increase in the load current can be achieved with rising environmental temperature in the power supply circuit previously explained. The transducer 41 can be implemented, for example, in such a manner that the temperature measurement signal S4 becomes smaller with rising environmental temperature. In this case, the load current decreases with increasing environmental temperature when the control principle explained previously is applied, in order to thus reduce the power consumption of the load and thus to oppose any further rise in the environmental temperature.

When driving light-emitting diodes, in particular, it may be appropriate to increase the load current IL with increasing environmental temperature. This is based on the finding that the light yield of light-emitting diodes decreases with increasing environmental temperature and that this reduction in the light yield can be counteracted by increasing the load current flowing through the light-emitting diodes. Such an increase in the load current with rising environmental temperature can be achieved by the transducer 41 being implemented in such a manner that the temperature measurement signal S4 increases with rising environmental temperature detected by the sensor 42.

For the first case of a temperature measurement signal S4 decreasing with rising temperature the sensor 42 and the transducer 41 can be jointly implemented by an NTC (negative temperature coefficient) resistor whereas, for the second case of a temperature measurement signal S4 rising with rising temperature, the sensor 42 and the transducer 41 can be implemented by a PTC (positive temperature coefficient) resistor. Such sensors are basically known so that no further explanations in this regard are required.

More complex sensors or sensor arrangements may also be used, for example sensors which supply an increasing measurement signal up to a threshold temperature and supply a decreasing measurement signal at temperatures above the threshold value. The slope of the measurement signal for temperatures below the threshold value is preferably less than that for temperatures above the threshold value. With such a sensor arrangement, the load current is initially increased with rising temperature in order to initially equalize the light yield decreasing with increasing temperature with a light-emitting diode as load, and reduces it when a temperature threshold value has been reached in order to prevent any overheating of the arrangement.

Figure 8:
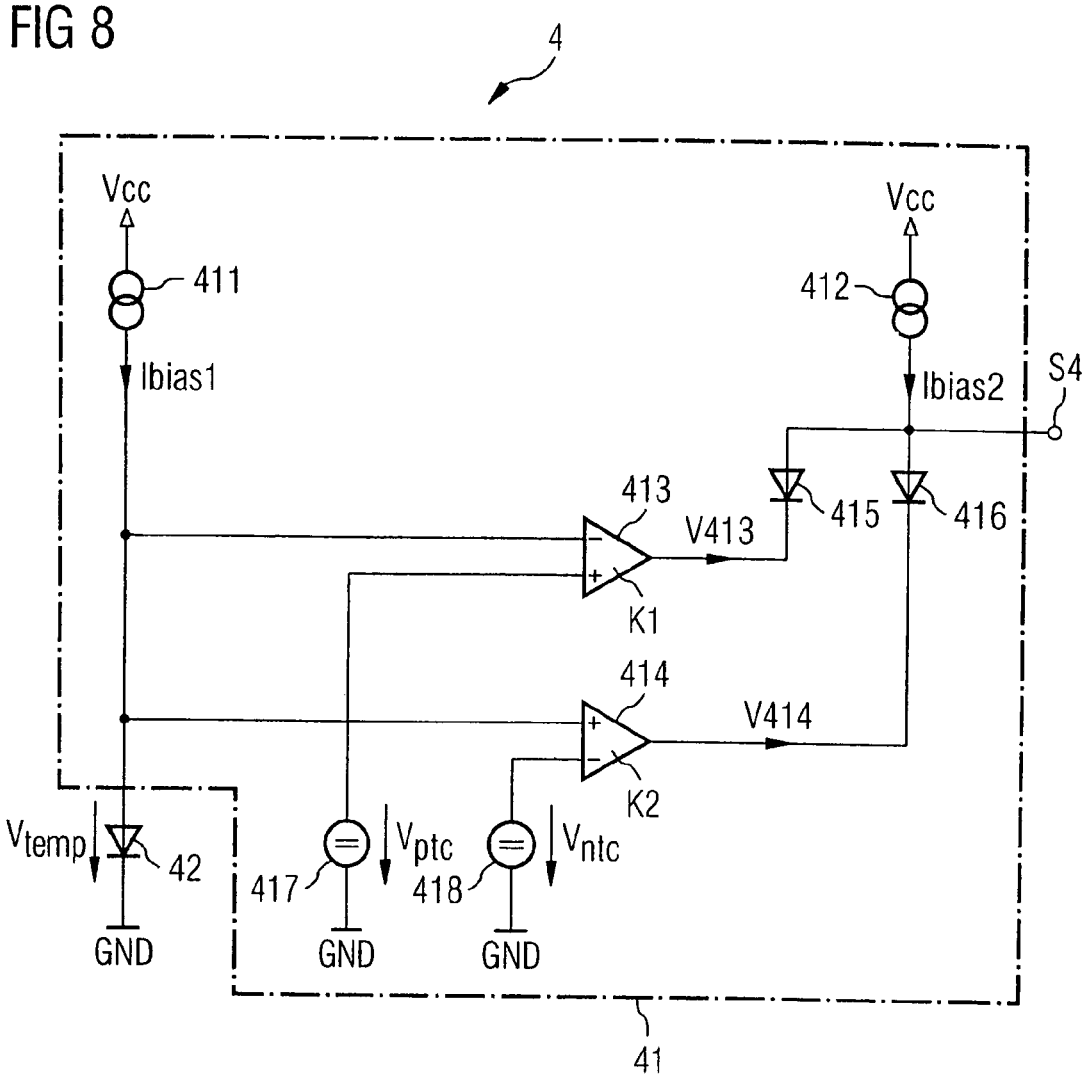
FIG. 8 shows an exemplary embodiment of a sensor arrangement.
Figure 9A:
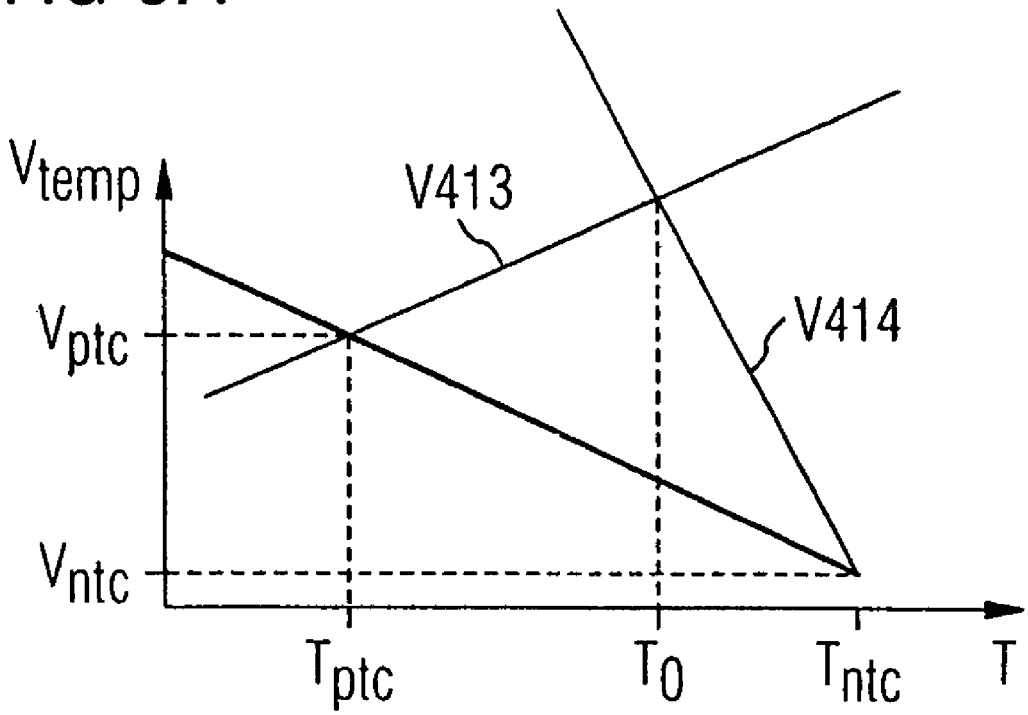
FIG. 9 illustrates temperature dependences of individual signals occurring in the sensor arrangement according to FIG. 8.
Figure 9B:
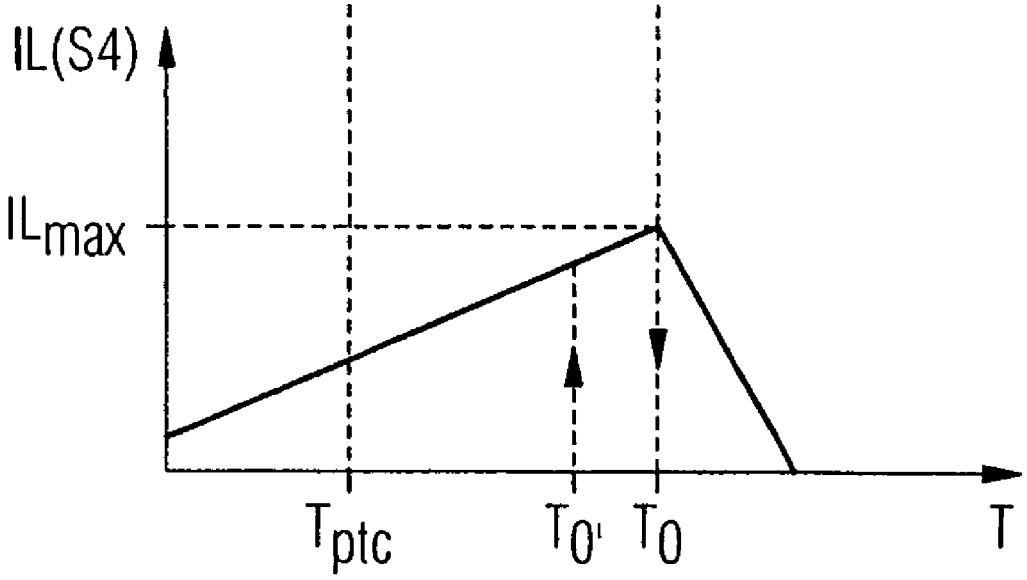

An example of such a sensor arrangement is shown in FIG. 8. FIG. 9B shows an output signal S4 of this sensor arrangement 4 in dependence on the temperature T.

The sensor arrangement 4 of FIG. 8 has a diode as temperature sensor 42 which is connected in series with a first current source 411 between a terminal for a supply potential Vcc of the sensor 4 and a terminal for a reference potential. The current source 411 supplies a constant current Ibias1 which produces a voltage drop Vtemp across the diode 42 polarized in the forward direction. This voltage drop Vtemp is temperature-dependent due to the physical characteristics of a diode and thus supplies a measure of the environmental temperature in the area of the diode 42. Referring to FIG. 9A, in which the temperature voltage Vtemp is plotted against the temperature T, the temperature voltage Vtemp decreases with increasing temperature. Within a temperature range which is of interest for operating light-emitting diodes and which, for example, is between −40° C. and 175° C., the dependence of the temperature voltage Vtemp on the temperature T can be considered to be approximately linear.

To evaluate the temperature voltage Vtemp, the evaluating circuit 41 of the sensor arrangement has two differential amplifiers 413, 414, a first differential amplifier 413 which generates a first difference signal V413 which depends on a difference between a first reference voltage Vptc which is provided by a first reference voltage source 417, and the temperature voltage Vtemp. A second 414 one of the differential amplifiers supplies a second difference signal V414 which depends on a difference between a second reference voltage Vntc which is provided by a second reference voltage source 418, and the temperature voltage Vtemp. The two differential amplifiers 413, 414 are interconnected with the diode 42 and the reference voltage sources 417, 418 in such a manner that the first difference signal V413 increases with increasing temperature whereas the second difference signal V414 decreases with increasing temperature T. The first differential amplifier 413 is supplied with the temperature signal Vtemp at its inverting input for this purpose and the first reference voltage Vptc is supplied with the temperature signal Vtemp at its non-inverting input, and the second differential amplifier 414 is supplied with the temperature signal Vtemp for this purpose at its non-inverting input and the second reference voltage Vntc at its inverting input.

The differential amplifiers are implemented in such a manner that their difference voltages correspond to an offset voltage of greater than zero with a voltage difference of zero at their inputs, this offset voltage corresponding, for example, to the offset of the input voltages. The following then applies for Vtemp=Vptc: V413-Vptc. Correspondingly, for Vtemp=Vntc applies: V414=Vntc. With this assumption, the difference voltages V413, V414 are shown diagrammatically in FIG. 9A. It must be noted that the slopes of the curves of the difference voltages V413, V414 and the slope of the curve of the temperature voltage Vtemp are not shown to scale.

The outputs of the differential amplifiers 413, 414 are connected via reverse-connected diodes 415, 416 to the output of the sensor arrangement 4 at which the sensor signal S4 is available. Between this output and the terminal for the supply potential Vcc, a second current source 412 is also connected which is used as load for the outputs of the differential amplifiers 413, 414. The diodes 415, 416 ensure that the smaller one of the difference voltages V413, V414 in each case, plus a forward voltage of the diode 415, 416 is output as temperature measurement signal.

The operation of this sensor arrangement of FIG. 8 will become clear by variation of the sensor signal S4 with temperature, shown in FIG. 9B, the sensor signal S4 being proportional to the load current IL in a manner already explained so that the curve shown in FIG. 9B also reproduces the dependence of the load current IL on the temperature T. In the sensor arrangement shown, the first reference voltage Vptc is greater than the second reference voltage. Starting with low temperature values, the first difference voltage V413 is thus initially lower than the second difference voltage so that the rising first difference voltage V413 dominates the temperature measurement signal.

In FIG. 9, $T_0$ designates a threshold value of the temperature T at which the curve of the second difference voltage V414, dropping with rising temperature, intersects the curve of the second difference voltage rising with rising temperature. From this temperature onward, the falling second difference voltage V414 dominates the variation of the temperature signal S4. The gains k1 and k2 of the first and second amplifier 413, 414 are selected in the sensor arrangement shown, in such a manner that k1<k2. The slope of the temperature signal S4, or of the load current, respectively, which rises for temperatures lower than $T_0$, is thus less than the slope of the temperature signal S4, or of the load current, respectively, which drops for temperatures greater than $T_0$, in order to achieve a rapid lowering of the load current as protection against overtemperatures when the threshold value is exceeded.

The threshold value $T_0$, or a threshold voltage $Vtemp_0$ associated with this threshold value via the temperature curve of the diode 42 is dependent on the first and second reference voltages Vptc, Vntc and the gain factors of the differential amplifiers. The following applies at the point of intersection of the curves of the first and second difference voltages:

$$V413=V414 \tag{3}$$

taking into consideration $$V413=Vptc+k1(Vptc-Vtemp) \tag{4a}$$

$$V414=Vntc+k2(Vtemp-Vntc) \tag{4b}$$

it follows from equation (1) for the threshold voltage $Vtemp_0$ that:

$$Vtemp_0=[(1+k1)\cdot Vptc+(k2-1)\cdot Vntc]/(k1+k2) \tag{5}.$$

The temperature threshold value $T_0$ is obtained from this voltage $Vtemp_0$ by means of the variation of the temperature voltage Vtemp.

Optionally, the gain of the second differential amplifier 414 may be selected to be very much greater than 1 and very much greater than that of the first differential amplifier 413 so that the temperature measurement signal S4 drops very steeply when the threshold value $T_0$ is reached which is shown dashed in FIG. 9B. In this case, the second differential amplifier 414 has a hysteresis characteristic so that the temperature measurement signal S4, when the temperature drops to a further threshold value $T_0'$, rises again steeply to a value predetermined by the first operational amplifier 413. In this case, the threshold voltage corresponds to the second reference voltage and the temperature threshold value $T_0$ corresponds to a reference temperature Tntc at which the temperature voltage Vtemp corresponds to the second reference voltage Vntc.

Figure 7:
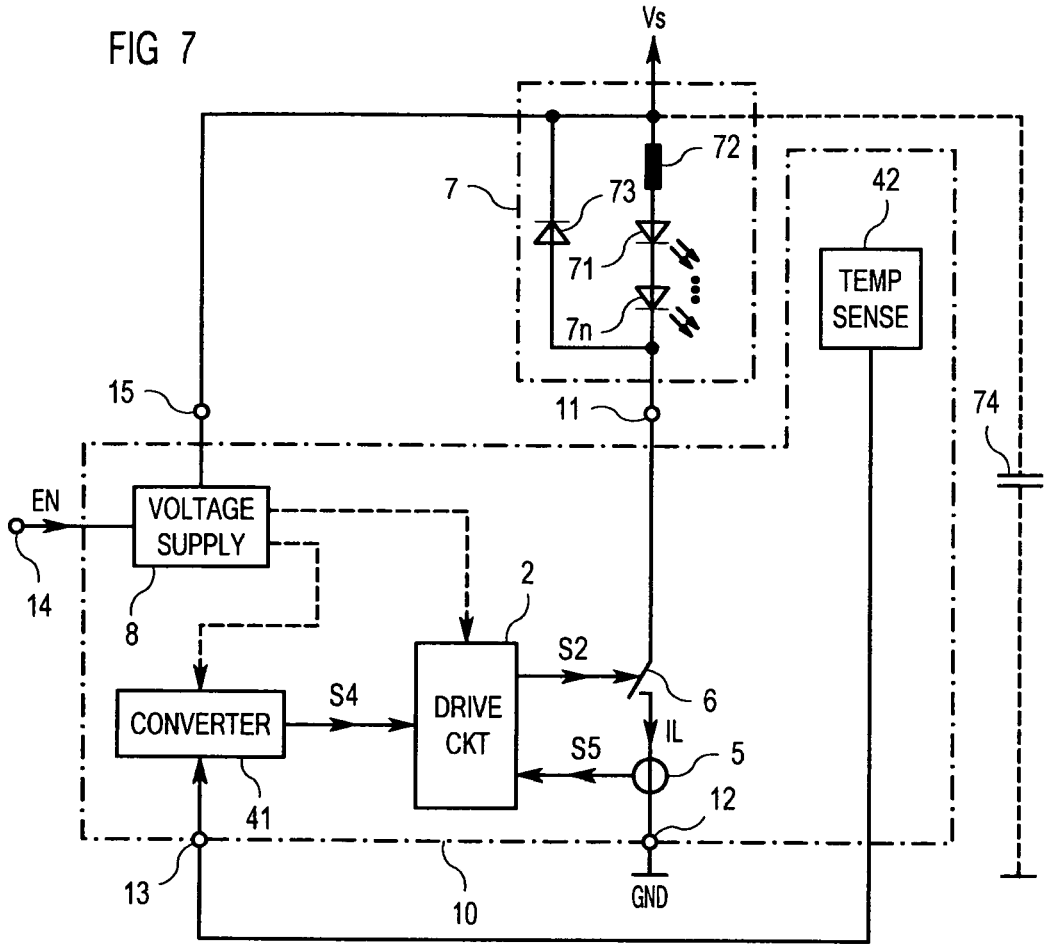
FIG. 7 shows an exemplary embodiment of a power supply circuit according to at least one embodiment of the invention which has an enable circuit.

FIG. 7 shows a further exemplary embodiment of a power supply circuit according to the invention. This power supply circuit differs from that shown in FIG. 2 in the presence of an enable circuit 8 which can be supplied with an enable signal EN via an input 14. This enable circuit 8 is connected, for example, via a further connection 15 to the terminal for the supply voltage potential VS and is constructed for ensuring the voltage or current supply of the remaining circuit components of the power supply circuit 10, particularly of the drive circuit 2 and of the temperature sensor 42 in dependence on the enable signal EN. The enable signal EN is, for example, a two-valued signal. The enable circuit 8 is constructed, for example, in such a manner that it provides a voltage supply for the circuit components of the power supply circuit 10 with a first signal level of the enable signal EN in order to ensure the clocked operation of the switching element 6 explained previously. With a second signal level of the enable signal EN, the enable circuit 8 interrupts the voltage supply of the circuit components of the power supply circuit 10 as a result of which the switching element 6 can no longer be driven to conduct via the drive circuit 2 and therefore blocks for the period during which this second signal level of the enable signal EN is present.

The enable signal makes it possible to switch the power supply circuit on or off by means of a microcontroller (μC) or another low-voltage or non-power component. In a manner not shown in greater detail, it is possible, in particular, to provide a number of the power supply circuits shown which are activated or deactivated at the same time or offset in time by a control circuit via the enable inputs.

With the power supply circuit 10 shown in FIG. 6, a clocked switching-on and -off of the power supply circuit 10 can be superimposed on the clocked drive of the switching element 6 by the enable signal EN. The enable signal applied is in this case a pulse-width-modulated signal, the pulse duration of which is greater than the duration of a drive cycle of the switching element 6. When light-emitting diodes are driven, this "higher-level" pulse-width-modulated activation of the power supply circuit 10 allows it to adjust, for example, a brightness of the light-emitting diodes which is perceived by the human eye. During an off phase of the power supply circuit during which the load current drops, the brightness of the light-emitting diodes decreases whereas it increases again in a subsequent on phase. If the frequency of the pulse-width-modulated signal is selected to be high enough, the human eye perceives this change between bright phases and dark phases of the light-emitting diodes as uniform luminescence, the intensity of which decreases with increasing dark phases.

Figure 10A:
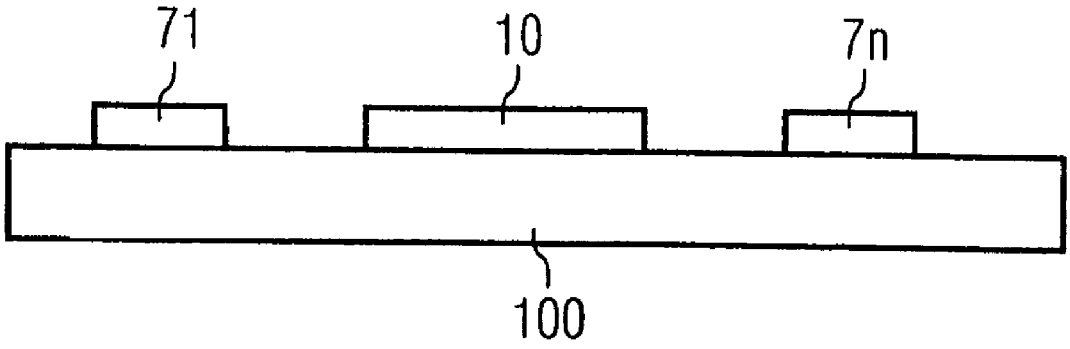
FIG. 10 shows a power supply circuit according to an embodiment of the invention arranged on a carrier, with connected load, in a side view, in cross section (FIG. 10A) and in a top view (FIG. 10B).
Figure 10B:
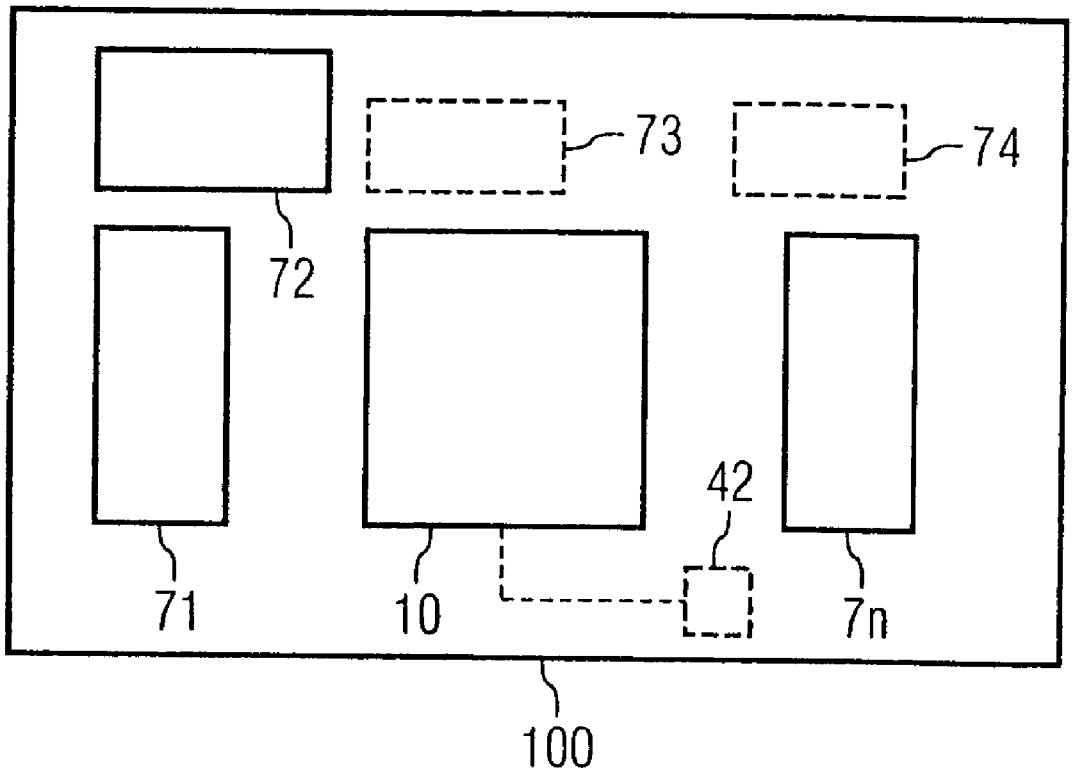

Referring to FIG. 10, the power supply circuit 10 and the load driven by the power supply circuit 10 can be arranged on a common support 100. FIG. 9A shows this support in a side view in cross section. FIG. 9B shows a top view of the support. The support can be implemented, for example, as conventional printed circuit board (PCB), on which circuit tracks (not shown) are applied for interconnecting the individual components. The power supply circuit 10 is implemented, for example, as integrated circuit which has a number of external connections (not shown) for ensuring a voltage supply and for connecting the load. For the presentation in FIG. 9, it is assumed that the load has two light-emitting diodes 71, 7*n* which are only shown diagrammatically as blocks in FIG. 9. To provide better heat removal or uniform heat distribution on the printed circuit board, the two light-emitting diodes 71, 7*n* are arranged spaced apart from one another in the lateral direction on the circuit board 100, the power supply circuit 10 being arranged between the light-emitting diode 71, 7*n*. The reference symbols 72 and 74 in FIG. 9 designate the blocks or positions of the inductive storage element and of the buffer capacitor which is present as an option. The circuit block shown dashed and provided with the reference symbol 73 represents the freewheeling element in an implementation in which the freewheeling element is implemented as separate component outside the drive circuit 10. As an alternative, this freewheeling element can be integrated in the drive circuit in a manner already explained.

The printed circuit board 11 of the arrangement shown in FIG. 9 may be utilized as heat conductor from the heat-generating light-emitting diodes 71, 7*n* to the temperature sensor 42 in FIG. 1. The temperature sensor can thus be arranged at a distance from the heat sources 71, 7*n* and, in particular, can be integrated in the integrated circuit of the power supply circuit 10. It is also possible to implement the temperature sensor 42 as "external" component of the power supply circuit 10 as is shown dashed in FIG. 9. With two light-emitting diodes arranged spaced apart from one another, it is sufficient to provide one temperature sensor in the area of one light-emitting diode if the light-emitting diodes 71, 7*n* are implemented in such a manner that an equal heat development with equal load current can be assumed.

While the invention disclosed herein has been described in terms of several preferred embodiments, there are numerous alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A power supply circuit comprising:

a load current path configured for connection to a load, the load current path including a switching element;

a current sensor configured to provide a current measurement signal dependent on a load current through the load current path;

a temperature sensor arrangement including a temperature sensor configured to determine an environmental temperature in the area of the temperature sensor, the temperature sensor arrangement configured to provide a temperature measurement signal dependent on the environmental temperature; and a drive circuit configured to provide a clocked drive signal with a plurality of drive cycles for the switching element, each of the plurality of drive cycles including an on period and an off period, the clocked drive signal being dependent on the current measurement signal and the temperature measurement signal, wherein the drive signal is dependent on the temperature measurement signal and the current measurement signal such that the load current increases with a rising temperature until a threshold value is reached and the load current decreases after this threshold value has been reached.

2. The power supply circuit of claim 1 wherein a duty ratio of the clocked drive signal is dependent on the current measurement signal and the temperature measurement signal.

3. The power supply circuit of claim 2 wherein the duty ratio decreases at least temporarily with an increasing environmental temperature indicated by the temperature measurement signal.

4. The power supply circuit of claim 1 wherein a slope of an increase in the current for temperatures below the threshold value is smaller than a slope of a decrease in the current for temperatures above the threshold value.

5. The power supply circuit of claim 1 wherein the drive circuit is configured to block the switching element for a predetermined off period during a drive cycle, wherein the predetermined off period begins when the current measurement signal rises up to a value dependent on the temperature measurement signal.

6. The power supply circuit of claim 1 wherein the switching element is a power transistor.

7. The power supply circuit of claim 1 further comprising an enable circuit including an input configured to receive an enable signal, wherein the enable circuit is configured to enable the power supply circuit to provide a load current on the load current path in dependence on the enable signal.

8. A circuit arrangement comprising:

a power supply circuit comprising, (i) a load current path including a switching element;

(ii) a current sensor configured to provide a current measurement signal dependent on a load current through the load current path;

(iii) a temperature sensor arrangement including a temperature sensor configured to determine an environmental temperature in the area of the temperature sensor, the temperature sensor arrangement configured to provide a temperature measurement signal dependent on the environmental temperature; and (iv) a drive circuit configured to provide a clocked drive signal with a plurality of drive cycles for the switching element, each of the plurality of drive cycles including an on period and an off period, the clocked drive signal being dependent on the current measurement signal, wherein the drive signal is dependent on the temperature measurement signal and the current measurement signal such that the load current increases with a rising temperature until a threshold value is reached and the load current decreases after this threshold value has been reached and the temperature measurement signal; and a load connected to the load current path of the power supply circuit, the load including at least one light-emitting diode.

9. The circuit arrangement of claim 8 further comprising an inductive storage element connected in series with the at least one light-emitting diode.

10. The circuit arrangement of claim 9 further comprising a freewheeling element connected in parallel with a series circuit that includes the least one light-emitting diode and the inductive storage element.

11. The circuit arrangement of claim 8 wherein the power supply circuit and the load are arranged on a common support.

12. The circuit arrangement of claim 11 wherein the temperature sensor is arranged spaced apart from the load on the support.

13. The circuit arrangement of claim 8 wherein the power supply circuit is at least partially integrated in a semiconductor chip separated from the load.

14. The circuit arrangement of claim 13 wherein the temperature sensor is integrated in the semiconductor chip of the power supply circuit.

15. The circuit arrangement of claim 8 wherein a duty ratio of the clocked drive signal is dependent on the current measurement signal and the temperature measurement signal.

16. The circuit arrangement of claim 15 wherein the duty ratio decreases at least temporarily with an increasing environmental temperature indicated by the temperature measurement signal.

17. The circuit arrangement of claim 8 wherein the drive circuit is configured to block the switching element for a predetermined off period during a drive cycle, wherein the predetermined off period begins when the current measurement signal rises up to a value dependent on the temperature measurement signal.

18. A circuit arrangement comprising:

a load;

a load current path connected to the load, the load current path including a switching element;

means for providing a current measurement signal dependent on a load current flowing through the load current path;

means for determining an environmental temperature in an area of the load and for providing a temperature measurement signal dependent on the environmental temperature; and means for providing a clocked drive signal with a number of drive cycles for the switching element, each drive cycle having an on period and an off period, the clocked drive signal being dependent on the current measurement signal and the temperature measurement signal, wherein the drive signal is dependent on the temperature measurement signal and the current measurement signal such that the load current increases with a rising temperature until a threshold value is reached and the load current decreases after this threshold value has been reached.

* * * * *